United States Patent [19]

Mandelbaum

[11] Patent Number: 4,779,720

[45] Date of Patent: Oct. 25, 1988

[54] COMBINATION DISPLAY STRUCTURE AND SHIPPING CARTON, ESPECIALLY FOR NECKTIES AND THE LIKE

[75] Inventor: Andrew M. Mandelbaum, Beverly Hills, Calif.

[73] Assignee: Superba, Inc., Los Angeles, Calif.

[21] Appl. No.: 33,229

[22] Filed: Apr. 2, 1987

[51] Int. Cl.[4] ..... B65D 5/50; B65D 85/18

[52] U.S. Cl. ..... 206/45.15; 206/45.3; 206/285; 206/291; 206/297; 211/119; D6/315

[58] Field of Search ..... 206/45.14, 45.15, 45.28, 206/45.29, 45.30, 278, 279, 284, 285, 289, 290, 291, 292, 295, 297, 296, 288; 229/15, 42; 190/36; D6/315, 317, 320, 323, 328, 566, 569; 211/94, 119

[56] References Cited

U.S. PATENT DOCUMENTS

| | | | |
|---|---|---|---|
| D. 276,770 | 12/1984 | Kean | D6/323 |
| D. 280,047 | 8/1985 | Benedict | D6/328 |
| 416,502 | 12/1889 | Rubin | 206/45.14 X |
| 1,350,744 | 8/1920 | Sonn | 229/15 |
| 1,357,700 | 11/1920 | Goldstein | 206/292 X |
| 1,731,745 | 10/1929 | Huebner | 206/296 |
| 1,770,701 | 7/1930 | Kelly | 229/15 |
| 2,403,834 | 7/1946 | Streit | D6/328 X |
| 2,587,706 | 3/1952 | Deline | 229/15 |
| 2,596,412 | 5/1952 | Kish, Jr. et al. | 206/292 |
| 2,608,292 | 8/1952 | Stensgaard . | |
| 2,656,914 | 10/1953 | Gordon | 206/284 X |
| 2,730,232 | 1/1956 | Coe . | |
| 3,118,535 | 1/1964 | Bauman | 229/15 X |
| 3,168,192 | 2/1965 | Nicholson et al. . | |
| 4,201,291 | 5/1980 | Davidson | 206/44 R |
| 4,416,369 | 11/1983 | Burns | 206/45.28 X |
| 4,579,220 | 4/1986 | Brundage | 206/45.25 |

FOREIGN PATENT DOCUMENTS

| | | | |
|---|---|---|---|
| 137498 | 6/1948 | Australia | 206/290 |
| 458862 | 4/1928 | Fed. Rep. of Germany | 206/45.14 |
| 1197516 | 6/1959 | France | 206/290 |
| 1495596 | 8/1967 | France | 206/45.14 |
| 78679 | 6/1951 | Norway | 206/290 |

*Primary Examiner*—Stephen Marcus
*Assistant Examiner*—Bryon Gehman
*Attorney, Agent, or Firm*—Harvey S. Hertz

[57] ABSTRACT

A combination shipping and display structure for neckties or the like. A generally rectangular, open-faced inner carton includes an assembly of tie hanger rods supported from an assembly of horizontal and vertical rods. The top of the inner carton folds backward and includes a flap affording an advertising panel and a tongue retained between the carton back panel and a top horizontal rod member in the display mode. A retainer assembly including spaced U-shaped apertures and baffles laterally supports columns of ties on the hangers. The inner carton and retainer assembly are inserted into a conventional outer carton for shipping.

15 Claims, 2 Drawing Sheets

FIG. 2
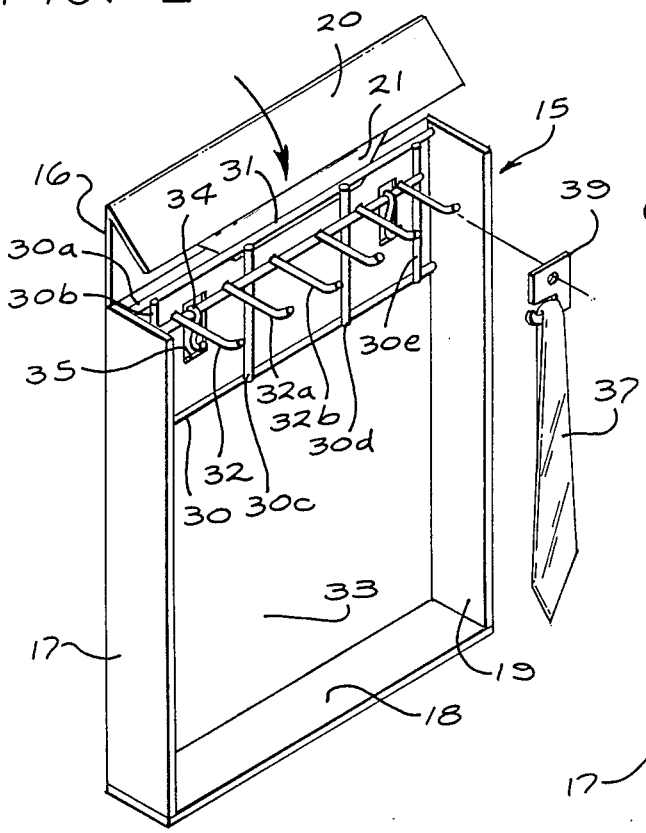
FIG. 3
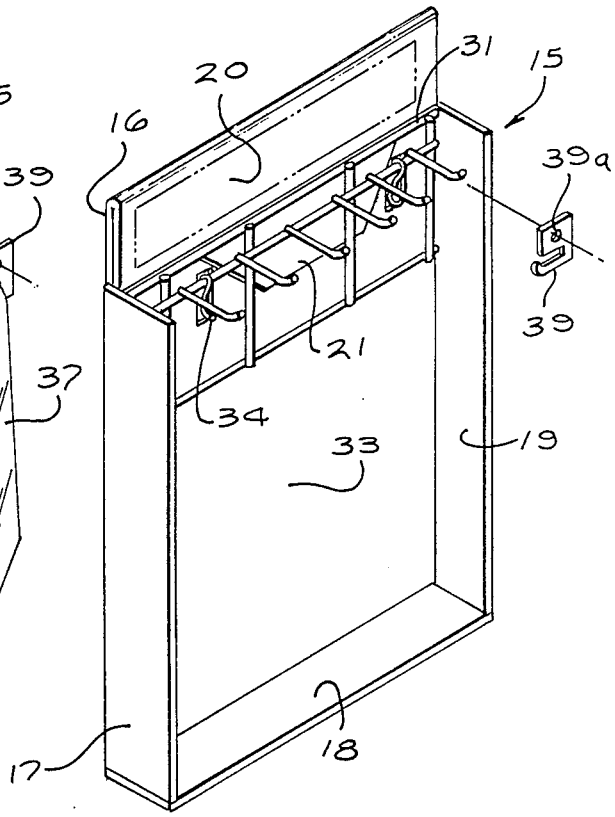
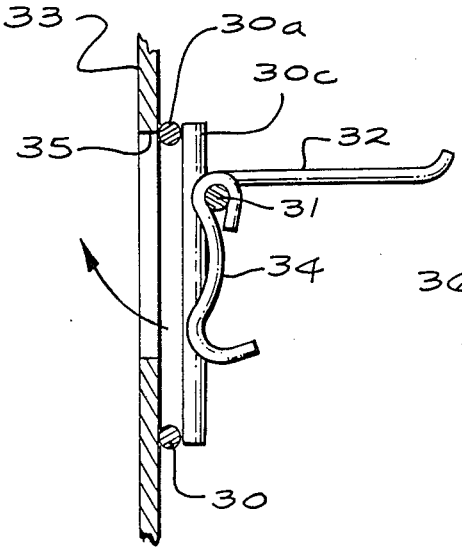
FIG. 4
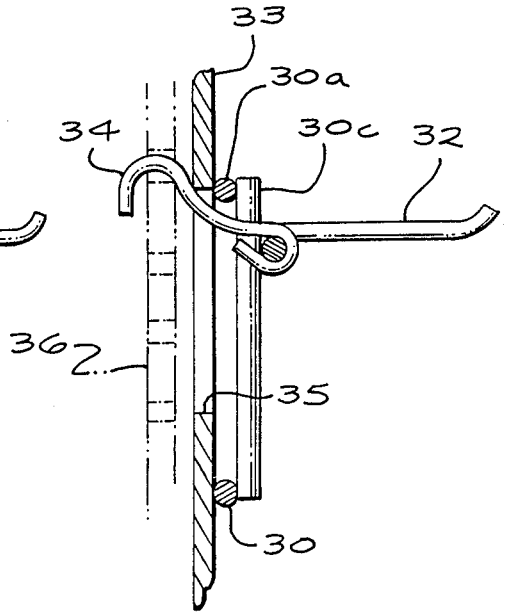
FIG. 5

COMBINATION DISPLAY STRUCTURE AND SHIPPING CARTON, ESPECIALLY FOR NECKTIES AND THE LIKE

BACKGROUND OF THE INVENTION

This invention relates generally to carton structures serving as combined shipping containers and display racks, and more spcifically to such carton structures for neckties or similar articles.

Combination shipping and display containers have been fabricated in various forms for transport and subsequent display of various articles without the necessity for transferring the articles from one container to another. Usually, such containers or cartons are "fold-ups" from a die-cut flat cardboard blank. Usually such containers are fabricated to display a particular article. Such a prior art arrangement is disclosed in U.S. Pat. No. 4,579,220. In that container, the articles displayed are placed in a partitioned tray. No particular structure is otherwise provided for limiting the shifting around of the articles when the container is folded closed for shipment and the degree of security against shipping damage is minimal, i.e. is provided only by the walls of the display container themselves.

Other display cartons such as that of U.S. Pat. No. 3,168,192 are directed toward prevention of pilfering and are said to be adapted for shipping. However, additional wrapping or containment would likely be required. Again, articles displayed are in a partitioned tray.

U.S. Pat. No. 4,201,291 is a carton adapted for non-sag mounting on a wall or bulkhead and is adapted to fold closed for shipping.

Yet another display carton which protects the merchandise contained when it is in the closed mode, as for shipping, and displays it in a tilted forward manner when open, is shown in U.S. Pat. No. 2,730,232.

None of the aforementioned prior art is adapted for shipping of neckties with appropriate protection although U.S. Pat. Nos. 2,608,292 and 416,502 contemplate necktie display without significant shipping protection.

The requirements for protection of a shipment of neckties are unique. The ties must be prevented from ruffling during transport and be provided sufficient protection from damage which could result from rough handling of the shipping carton. Of course, tight packing in fitted boxes or tray compartments can afford protection. However, the ties must be unpacked and separately displayed otherwise in that case.

The manner in which the invention responds to the disadvantages of the prior art and contributes importantly to the art will be understood as this specification proceeds.

SUMMARY

It may be said to have been the general object of the invention to provide an effective and inexpensive combination shipping and display carton, particularly for neckties or the like.

The combination according to the invention includes an open-faced inner (display) carton of generally rectangular character and a plurality of spaced outwardly projecting hanger bars over which the ties are hung. A separate retainer assembly having separating baffles arranged to fit between the suspended ties is inserted into the inner carton after ties are emplaced over the hanger bars. Planar flap and tongue, which are extended portions of the rear wall of the inner carton, are folded over the top and the viewing opening of the inner carton. An outer carton is then provided into which the inner carton is inserted for shipment.

The aforementioned flap and tongue are doubled back into a generally vertical form providing an advertizing panel held in place by insertion of the tongue behind the hanger for support structure when the inner carton and its contents are displayed.

A pair of mounting hooks affixed to rotate outward from the inner carton structure provide for mounting on a wall or other generally vertical structure for display.

The details of a typical embodiment according to the invention are presented hereinafter.

BRIEF DESCRIPTION OF THE DRAWINGS

FIG. 2 is a pictorial view of the inner carton of the assembly with flap and tongue portions partly raised and illustrating the hanger bars and their supporting structure.

FIG. 3 is a view of the inner carton with the tongue inserted behind the tie bar supporting structure to provide a generally vertical panel for advertising, pricing date or the like.

FIG. 4 is a detail of the mounting hook arrangement in the retracted position for shipping.

FIG. 5 is a detail showing mounting hook rearward and outward rotation for inner carton vertical mounting.

DETAILED DESCRIPTION

Figure 1:
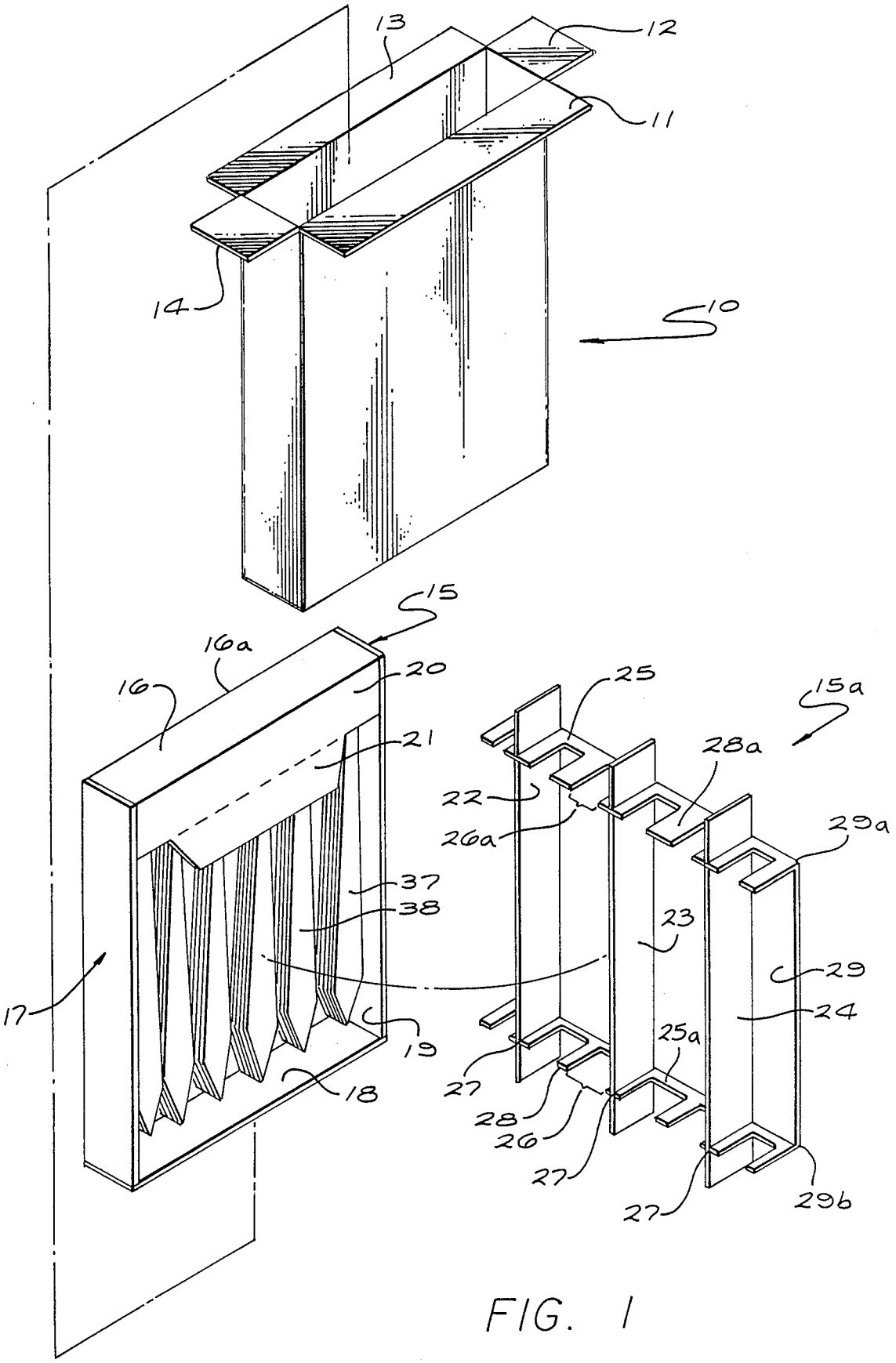
FIG. 1 is an exploded view of the assembly according to the invention.

Referring now to FIG. 1, an inner carton is seen at 15 with top 16, flap 20 and tongue 21 in place for insertion into outer carton 10 for shipment. Outer carton 10 has conventional foldover portions 11, 12, 13 and 14 facilitating closure of the outer carton as is well known in the box art.

The inner carton comprises top 16 hinged about edge 16*a*, sides 17 and 19 and bottom 18 as illustrated. A back 33 is seen in subsequent FIGS. 2 and 3.

The retainer assembly 15*a* fits into the display opening (aperture) of inner carton 15 such that the generally vertical baffles, typically 22, 23 and 24 fit between columns of ties represented typically at 37 and 38. The panel 29 then forms a closure for the open face of inner carton 15 and flaps 20 and 21 fold downward over retainer assembly 15*a* for insertion into outer carton 10 for shipping.

The retainer assembly 15*a* is preferably fabricated from a flat panel 29 and is die-cut in a flat pattern and bent to form the upper and lower multiple U-shaped orthogonally and horizontally extending portions (finger bars) 25 and 25*a*. Those bends are made along the edges 29*a* and 29*b* and a plurality of U-shaped slots such as 26 are formed. Each column of ties is thereby retained in lower apertures 26 and upper narrower aperture 26*a* framed by a projection such as 28 and 28*a* adjacent the bottom and top, respectively as will be appreciated from FIG. 1.

Baffles 22, 23 and 24 serve to prevent displacement of the columns of ties, these baffles being retained in at least some of the projections 28 where a slot 27 is provided for friction grip of the baffle therein.

The retainer assembly 15*a* is basically expendable once it has served its purpose during shipping.

The inner and outer cartons and the retainer assembly 15*a* are readily fabricated from cardboard of a grade well known in the box and carton art.

An assembly of rods comprising horizontal members 30, 30*a* and 31 along with vertical member 30*b*, 30*c*, 30*d* and 30*e* will be seen in both FIGS. 2 and 3, but the parts are fully identified individually only in FIG. 2. The hanger rods such as 32, 32*a*, 32*b* are are firmly affixed to horizontal rod 31, and rod 31 is firmly affixed to vertical rods 30*b*, 30*c*, 30*d* and 30*e*. Those vertical rods are, in turn, firmly affixed to horizontal rods 30 and 30*a*. At least rod 30*a* is spaced away from back panel 33 by an amount sufficiant to permit insertion of tongue 21 between rod 30*a* as indicated in FIG. 3. The only intended difference between FIGS. 2 and 3 is the position of carton top 16, flap 20 and tongue 21. FIG. 2 shows the start of insertion of tongue 21 between rod 30*a* and back panel 33 and FIG. 3 shows its completion. In the display position of FIG. 3, flap 20 normally will contain an advertising message.

The aforementioned rod assembly is most conveniently formed as an assembly of metal rod members affixed to each other as described, by welding, dip brazing or other known method. Rod 30*a* may be attached at its ends into or partially through side panels 17 and 19 of the inner carton 15 to provide for the minimal clearance for insertion of tongue 21 as hereinbefore described. The other horizontal rod member 30 may be cemented to the back panel 33 or otherwise affixed thereto. Planar hooks 39 include a hole 39*a* to engage hanger rods 32, 32*a* and 32*b* so that the hooks 39 slide over the respective hanger rods to suspend the ties thereon, as is conventional.

FIG. 4 illustrates hook 34, two of which are preferably included as shown in FIGS. 2 and 3. Hook 34 is rotatable about horizontal rod 31 and in FIG. 4, is in the retracted (shipping) position. In FIG. 5, hook 34 is shown rotated outward through slot 35 in back panel 33 to engage a mesh panel, peg board or other fixed structure 36 for mounting the assembly 15 vertically for display.

Although cardboard material is suggested for the inner carton and retainer assembly 15*a*, it will be realized that plastic materials are available for use in implementing the invention. Similarly, plastic materials could be used for the rod members described although their configuration would likely be somewhat different. The metal rod members suggested can be painted or coated to improve their display appearance.

Other modifications and variations will suggest themselves to those of skill in the art once the inventive concepts are understood. Accordingly, it is not intended that the scope of the invention be limited to the forms illustrated or described, the drawings and description being illustrative only.

I claim:

1. A combination shipping and display carton assembly for neckties or the like, comprising:

a generally rectangular first carton having plural back, side and bottom panels and an aperture substantially congruent and parallel with said back panel;

a laterally spaced plurality of hanger rods affixed within the interior of said first carton and projecting within said carton toward said aperture for hanging neckties or the like, said hanger rods being adjacent to the top of said first carton;

a removable retainer assembly comprising a cover panel inserted into said aperture for substantial closure thereof for shipping, said retainer assembly also including a plurality of spaced separator members extending within said first carton to provide lateral constraint between columns of neckties hanging from said hanger rods;

a top panel extending to form a flap, said top panel being hinged to said back panel at the upper edge of said back panel, said top panel being hinged to said flap whereby said flap extends a predetermined distance downward over said aperture when said top panel is in place over the top of said carton and said retainer assembly is in place;

and means for holding said top panel and said flap in substantially planar contact in generally vertical orientation when said first carton is in the display mode.

2. The combination set forth in claim 1 in which a second carton is provided into which said first carton fits snugly when said retainer assembly is in place for shipping.

3. The combination set forth in claim 1 in which said separator members include a plurality of vertically oriented baffles affixed in parallel planes all substantially perpendicular to said retainer assembly panel.

4. The combination defined in claim 1 in which said hanger rods are spaced along a generally horizontal line adjacent the top of said first carton and said separator members comprise first and second finger bars, said first finger bar being adjacent to but below said hanger rods and said second finger bar being adjacent to but above said first carton bottom panel when said shipping retainer assembly is in place within said first carton bottom panel, said finger bars providing a U-shaped projection surrounding each column of neckties hanging from a corresponding one of said hanger rods.

5. The combination defined in claim 4 in which said finger bars extend to contact said back panel within said first carton.

6. The combination defined in claim 5 in which a second closable carton sized to snugly enclose said first carton is included for shipping purposes.

7. The combination defined in claim 4 in which said finger bars are arranged to support a plurality of generally vertically oriented baffle panels, said baffle panels being spaced to enclose at least two of said columns of neckties between adjacent one of said baffles.

8. The combination defined in claim 7 in which a second closable carton sized to snugly enclose said first carton is included for shipping purposes.

9. The combination defined in claim 7 in which at least some said baffle panels extend within said first carton interior to contact said first carton back panel.

10. The combination defined claim 9 in which a second closable carton sized to snugly enclose said first carton is included for shipping purposes.

11. The combination according to claim 7 in which said finger bars and said baffle panels both extend within said first carton into contact with said first carton back panel.

12. The combination defined claim 11 in which a second closable carton sized to snugly enclose said first carton is included for shipping purposes.

13. The combination defined in claim 1 in which a second closable carton sized to snugly enclose said first carton is included for shipping purposes.

14. A combination shipping and display carton assembly for neckties or the like, comprising:

a generally rectangular, open-faced first carton having a spaced plurality of hanger rods attached to the interior surface of said first carton, said hanger rods projecting generally outward toward said first carton open face;

a plurality of planar hooks, one for each necktie which is packed into said first carton, said planar hooks each including a laterally open slot into which the corresponding necktie may be inserted such that said necktie is folded lengthwise, said planar hooks each acting as an individual hanger for corresponding necktie, each of said planar hooks including an opening therethrough for placement over one of said hanger rods, said neckties thereby being held in display position within said first carton;

and a removable retainer assembly comprising a panel having a plurality of spaced vertical separator members attached to and extending generally orthagonally from said panel, said separator members extending within said first carton generally parallel to the length dimension of said neckties and being placed to laterally separate columns of neckties within said first carton during shipping, said retainer assembly substantially closing said first carton open face with said separator members extending into said first carton.

15. The combination set forth in claim 14 in which a second carton is provided into which said first carton fits snugly when said retainer assembly is in place for shipping.

* * * * *